US008512455B2

(12) United States Patent
Yasuhiko et al.

(10) Patent No.: US 8,512,455 B2
(45) Date of Patent: Aug. 20, 2013

(54) ELECTRIC PRECIPITATOR

(75) Inventors: Kochiyama Yasuhiko, Seongnam-si (KR); Hyong-Soo Noh, Yongin-si (KR); Jun Ho Ji, Namyangju-si (KR); So Young Yun, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 524 days.

(21) Appl. No.: 12/662,556

(22) Filed: Apr. 22, 2010

(65) Prior Publication Data

US 2010/0288127 A1 Nov. 18, 2010

(30) Foreign Application Priority Data

May 12, 2009 (KR) ..... 10-2009-0041233

(51) Int. Cl.
*B03C 3/47* (2006.01)

(52) U.S. Cl.
USPC ..... 96/69; 96/83; 96/84; 96/86; 96/87; 96/88; 96/98

(58) Field of Classification Search
USPC ..... 96/83, 84, 86–88, 98, 69, 99, 100
See application file for complete search history.

(56) References Cited

U.S. PATENT DOCUMENTS

| | | | | |
|---|---|---|---|---|
| 2,978,066 | A * | 4/1961 | Nodolf | 96/87 |
| 3,114,616 | A * | 12/1963 | Palmore | 96/86 |
| 3,175,341 | A * | 3/1965 | Winter | 96/86 |
| 5,433,772 | A * | 7/1995 | Sikora | 96/87 |
| 5,547,496 | A * | 8/1996 | Hara | 96/79 |
| 6,852,149 | B2 * | 2/2005 | Huang | 96/79 |
| 6,958,089 | B1 * | 10/2005 | Huang | 96/79 |
| 7,241,330 | B2 * | 7/2007 | Moshenrose | 96/83 |
| 2004/0226448 | A1 | 11/2004 | Griffiths et al. | |
| 2008/0017035 | A1 * | 1/2008 | Paterson et al. | 96/84 |
| 2010/0132562 | A1 | 6/2010 | Noh et al. | |

FOREIGN PATENT DOCUMENTS

| | | | |
|---|---|---|---|
| JP | 63-181455 | | 11/1988 |
| JP | 1-262955 | | 10/1989 |
| JP | 4-322757 | A * | 11/1992 |
| JP | 5-104024 | | 4/1993 |
| JP | 7-8835 | | 1/1995 |
| JP | 07-284692 | | 10/1995 |
| JP | 2002-126576 | | 5/2002 |
| KR | 20-0295210 | | 11/2002 |

OTHER PUBLICATIONS

Extended European Search Report mailed Mar. 7, 2013 for corresponding European Application No. 10160589.7.

* cited by examiner

*Primary Examiner* — Richard L Chiesa
(74) *Attorney, Agent, or Firm* — Staas & Halsey LLP

(57) ABSTRACT

Disclosed herein is an electric precipitator including at least one high voltage electrode including a pair of film members made of a non-conductive material and attached to each other and an electrode layer disposed between the pair of film members, and at least one low voltage electrode disposed alternately with the at least one high voltage electrode such that that the at least one high voltage electrode and the at least one low voltage electrode are separated from each other. Support members made of an insulating member to maintain separation of the at least one high voltage electrode and the at least one low voltage electrode from each other are mounted on one of the at least one high voltage electrode and the at least one low voltage electrode.

21 Claims, 12 Drawing Sheets

ELECTRIC PRECIPITATOR

CROSS-REFERENCE TO RELATED APPLICATION

This application claims the benefit of Korean Patent Application No. 2009-0041233, filed on May 12, 2009 in the Korean Intellectual Property Office, the disclosure of which is incorporated herein by reference.

BACKGROUND

1. Field

Embodiments relate to an electric precipitator to collect contaminants, such as dust, using electrical attraction.

2. Description of the Related Art

In general, electric precipitators are apparatuses which are mounted in an air conditioner, etc., and are disposed in an air flow channel to collect contaminants, such as dust, from air passing through the electric precipitator using electrical attraction.

Each electric precipitator includes a plurality of electrodes to collect charged contaminants using electrical attraction, and the plurality of electrodes includes a plurality of high voltage electrodes, to which power of a relatively high voltage is applied, and a plurality of low voltage electrodes, to which power of a relatively low voltage is applied. The low voltage electrodes are disposed alternately with the plurality of high voltage electrodes so as to be separated from the plurality of high voltage electrodes.

Among these electric precipitators, there is an electric precipitator having a compact structure in which each of a plurality of high voltage electrodes includes a pair of film members and an electrode layer formed between the two film members to minimize the thickness of the high voltage electrodes.

The high voltage electrode including the pair of the film members and the electrode layer has a slim thickness, but also has a low strength. Therefore, when the length or width of the high voltage electrode is extended to a designated size or more, a central part of the high voltage electrode may sag and thus contact a low voltage electrode. Accordingly, it is difficult to apply the high voltage electrode including the pair of the film members and the electrode layer to an electric precipitator having a designated size or larger.

SUMMARY

Therefore, it is an aspect to provide an electric precipitator which stably separates electrodes from each other.

Additional aspects will be set forth in part in the description which follows and, in part, will be apparent from the description, or may be learned by practice of the invention.

The foregoing and/or other aspects are achieved by providing an electric precipitator including a high voltage electrode and at least one low voltage electrode separated from each other, the high voltage electrode including a pair of film members made of a non-conductive material and attached to each other, and an electrode layer disposed between the pair of film members, and a plurality of support members including an insulating member, and mounted on one of the high voltage electrode and the low voltage electrode to allow the film members to be supported by the low voltage electrode.

The support members may be mounted on the at least one low voltage electrode, and thus respectively support a pair of high voltage electrodes disposed at both sides of the at least one low voltage electrode.

The support members may be mounted on the at least one high voltage electrode, and thus respectively support a pair of low voltage electrodes disposed at both sides of the at least one high voltage electrode.

Mounting holes to mount the support members may be formed through one of the plurality of electrodes, and each of the support members may include a first support part provided with a mounting part formed integrally therewith and penetrating each of the mounting holes and a second support part provided with a connection recess, into which the front end of the mounting part protruded from the mounting hole is inserted.

Mounting holes to mount the support members may be formed through one of the plurality of electrodes, and each of the support members may include a mounting part penetrating each of the mounting holes and a pair of support parts respectively provided with connection recesses, into which both ends of the mounting part are respectively inserted.

Mounting recesses to mount the support members may be formed on one of the plurality of electrodes so as to be opened to a side end of the one of the plurality of electrodes, and each of the support members may include a mounting part mounted in each of the mounting recesses and a pair of support parts formed integrally with both ends of the mounting part.

Each of the mounting recesses may include an inlet part formed on the side end of the one of the plurality of electrodes so as to have a width similar to a width of each of the mounting parts, and a reception part formed at the inside of the inlet part in a shape corresponding to the mounting parts.

A pair of mounting recesses to mount the support members may be formed on one of the plurality of electrodes so as to be respectively opened to two electrodes neighboring the one of the plurality of electrodes, and each of the support members may include a pair of support parts respectively provided with mounting parts inserted into the mounting recesses.

The at least one high voltage electrode and the at least one low voltage electrode may be respectively formed in a flat plate shape, and be separated from each other in the thickness direction thereof.

The at least one high voltage electrode and the least one low voltage electrode may be respectively formed in a spiral plate shape, and be separated from each other in the circumferential direction thereof.

Two high voltage electrodes and two low voltage electrodes may be respectively provided, and a case to fix the high voltage electrodes and the low voltage electrodes may be formed at the outside of the plurality of electrodes.

Each of the at least one high voltage electrodes may further include a frame formed at the edge thereof to maintain the attachment of the film members and the electrode layer to each other.

The at least one high voltage electrode and the at least one low voltage electrode may be separated from each other by an interval of 1~3 mm by the support members.

A voltage of 4~8 kv may be applied to the at least one high voltage electrode.

The foregoing and/or other aspects are also achieved by providing an electric precipitator including a high voltage electrode, a low voltage electrode separated from the high voltage electrodes, and a plurality of support members including an insulating member to maintain separation of the high voltage electrode and the low voltage electrode.

Each of the high voltage electrodes may include a pair of film members made of a non-conductive material and attached to each other and an electrode layer disposed between the pair of film members, and the support members may support the film members to the at least low voltage electrode to prevent sagging of the film members.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
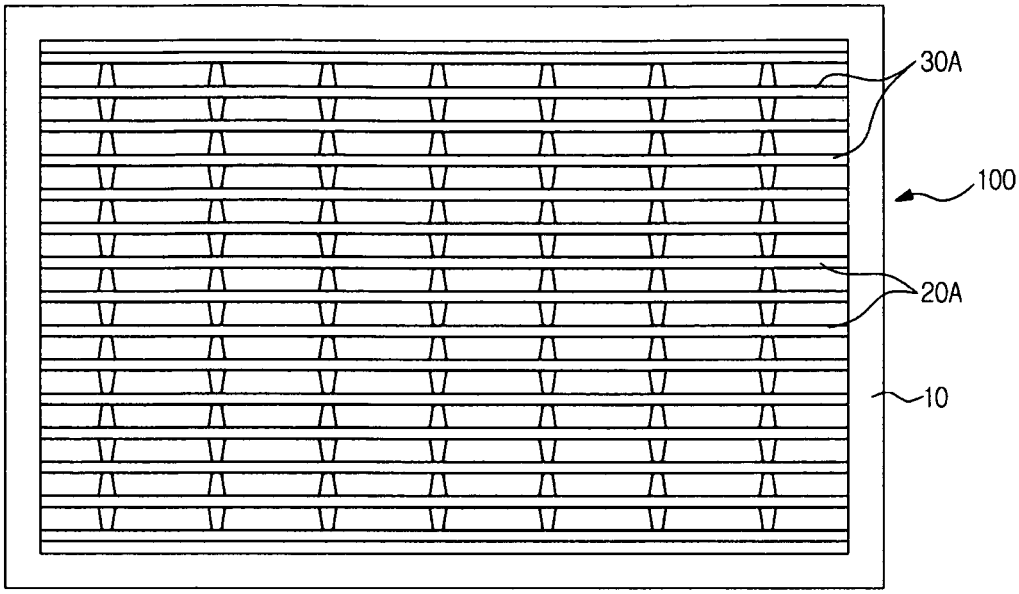
FIG. 1 is a schematic view of an electric precipitator in accordance with one embodiment.

Reference will now be made in detail to the embodiments, examples of which are illustrated in the accompanying drawings, wherein like reference numerals refer to the like elements throughout.

As shown in FIG. 1, an electric precipitator 100 in accordance with one embodiment is an apparatus which is disposed in an air flow channel to collect contaminants, such as dust, contained in air. The electric precipitator 100 includes a case 10 forming the external appearance of the electric precipitator 100, and a plurality of electrodes 20A and 30A disposed in the case so as to be separated from each other to collect the contaminants, such as dust. The case 10 is formed at the outside of the plurality of electrodes 20A and 30A such that the plurality of electrodes 20A and 30A is fixed to the case 10.

The electrodes 20A and 30A include at least one high voltage electrode 20A, to which a relatively high voltage is applied, to collect contaminants, such as dust, and at least one low voltage electrode 30A, to which a relatively low voltage is applied, compared with the at least one high voltage electrode 20A. The electrodes 30A are disposed alternately with the at least one high voltage electrode 20A such that the at least one high voltage electrode 20A and the at least one low voltage electrode 30A are separated from each other in the thickness direction. Here, the at least one high voltage electrode 20A and the at least one low voltage electrode 30A are respectively formed in a flat plate shape.

Figure 2:
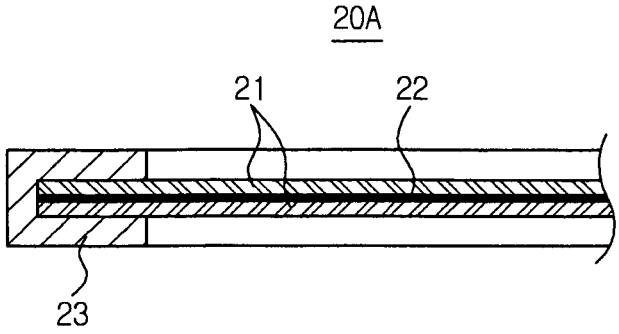
FIG. 2 is a partially-sectional view of a high voltage electrode of the electric precipitator in accordance with the embodiment.

As shown in FIG. 2, each of the at least one high voltage electrode 20A includes a pair of film members 21, an electrode layer 22 disposed between the pair of film members 21, and a frame 23 supporting edge parts of the film members 21 and the electrode layer 22 to stably maintain a close attachment state of the film members 21 and the electrode layer 22. The at least one low voltage electrode 30A is made of a plate made of a conductive material, such as a metal plate.

If the high voltage electrode 20A is formed by the film members 21 and the electrode layer 22, as described above, the high voltage electrode 20A has a slim thickness, but has a low strength. Therefore, when the length or width of the high voltage electrode 20A is extended to a designated size or more, a central part of the high voltage electrode 20A may sag.

Figure 3:
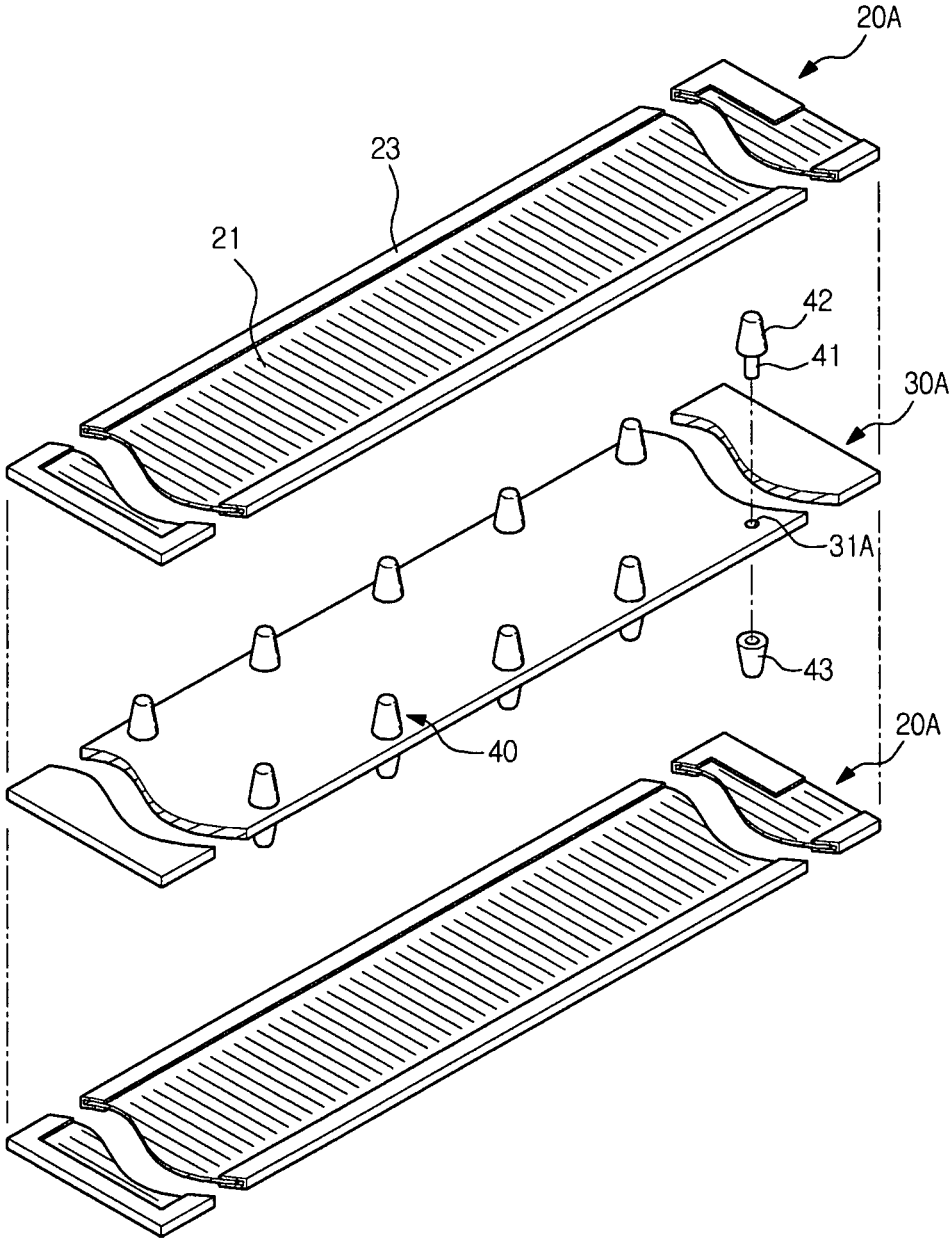
FIG. 3 is an exploded perspective view illustrating a mounting state of support members of the electric precipitator in accordance with the embodiment on a low voltage electrode.

Thus, support members 40, which are made of an insulating material and support the two neighboring electrodes 20A and 30A so as to allow the two neighboring electrodes 20A and 30A to be supported by each other, as shown in FIG. 3, are installed on some of the electrodes 20A and 30A of the electric precipitator. The support members 40 are disposed in two rows in the length direction of the low voltage electrodes 30A so as to allow the film members 21 to be supported by the low voltage electrodes 30A. In order to dispose the support members 40 in two rows, at least four support members 40 are provided.

Figure 4:
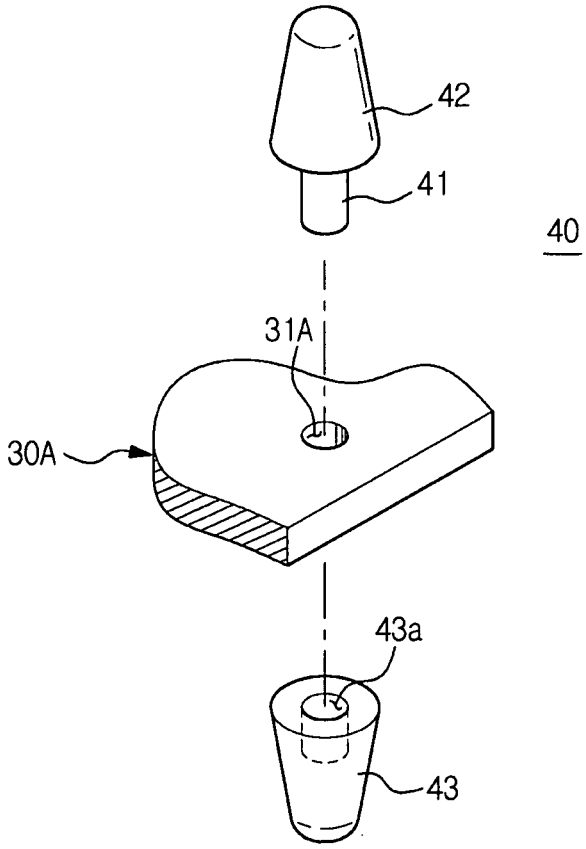
FIG. 4 is a perspective view illustrating a mounting structure of the support member of the electric precipitator in accordance with the embodiment.

As shown in FIG. 4, the support members 40 in accordance with this embodiment are mounted on the low voltage electrode 30A such that the front ends of the support members 40 respectively support the high voltage electrodes 20A, and mounting holes 31A to mount the support members 40 on the low voltage electrode 30A are formed through the low voltage electrode 30A.

The support member 40 includes a mounting part 41 penetrating the mounting hole 31A, and a pair of support parts 42 and 43, the front ends of which are supported by the film members 21 of the high voltage electrodes 20A located to neighbor both sides of the low voltage electrode 30A, on which the support member 40 is mounted, so as to maintain a separation state of the film members 21 from the low voltage electrode 30A by a designated interval. The mounting part 41 penetrates the mounting hole 31A, and connects the pair of support parts 42 and 43. In this embodiment, the pair of support parts 42 and 43 includes a first support part 42 provided with the front end supported by the film member 21 of the high voltage electrode 20A located at one side of the low voltage electrode 30A, and the rear end with which the mounting part 41 is formed integrally, and a second support part 43 provided with a connection recess 43*a*, into which the front end of the mounting part 41 is inserted, and the front end supported by the film member 21 of the high voltage electrode 20A located at the other side of the low voltage electrode 30A.

The respective support parts 42 and 43 may be formed to have a length of 1~3 mm such that an interval between the film members 21 of the high voltage electrodes 20A and the low voltage electrode 30A is maintained at 1~3 mm. In this embodiment, the respective support parts 42 and 43 are formed to have a length of 2 mm such that the interval between the film members 21 of the high voltage electrodes 20A and the low voltage electrode 30A is maintained at 2 mm.

Therefore, the film member 21 of the high voltage electrode 20A located at one side of the low voltage electrode 30A is supported by the front ends of the first support parts 42 such that the interval between the film members 21 of the high voltage electrode 20A and the low voltage electrode 30A is maintained at 2 mm. The film member 21 of the high voltage electrode 20A located at the other side of the low voltage electrode 30A is supported by the front ends of the second support parts 43 such that the interval between the film members 21 of the high voltage electrode 20A and the low voltage electrode 30A is maintained at 2 mm. Here, the first support parts 42 and the second support parts 43 have cross-sectional areas which are gradually decreased toward the front ends thereof, so as to maximize dust collection areas of the high voltage electrodes 20A by minimizing contact areas of the first support parts 42 and the second support parts 43 with the high voltage electrodes 20A.

Therefore, the support members 40 are mounted on the low voltage electrode 30A by inserting the mounting parts 41 formed integrally with the first support parts 42 into the connection recesses 43*a* of the second support parts 43 via the mounting holes 31A. The low voltage electrodes 30A provided with the support members 40 mounted thereon and the high voltage electrodes 20A are alternately disposed so as to be separated from each other such that the film members 21 of the two high voltage electrodes 20A neighboring the low voltage electrode 30A provided with the support members 40 mounted thereon are supported by the low voltage electrode 30A through the support members 40. Thus, sagging of the film members 21 is prevented.

If the interval between the high voltage electrode 20A and the low voltage electrode 30A is narrow, breakdown of the film member 21 is easily generated, and if the interval between the high voltage electrode 20A and the low voltage electrode 30A is wide, the dust collection efficiency of the electric precipitator 100 is lowered. Further, if voltage applied to the high voltage electrode 20A is high, the dust collection efficiency of the electric precipitator 100 is raised but breakdown of the film member 21 easily occurs. Therefore, when the separation state between the high voltage electrode 20A and the low voltage electrode 30A is maintained through the support members 40 made of an insulating material in accordance with this embodiment, even if power of a high voltage is applied to the high voltage electrode 20A, breakdown does not easily occur. As test results, when the interval between the high voltage electrode 20A and the low voltage electrode 30A is maintained at about 2 mm as in this embodiment, even if a voltage of 4~8 kv is applied to the high voltage electrode 20A, breakdown does not occur. These results mean that the electric precipitator 100 in accordance with this embodiment is greatly improved, as compared with a related electric precipitator which is designed such that it is operated at voltage of 3 kv or less so as to prevent the generation of breakdown.

Hereinafter, mounting structures of support members mounted on low voltage electrodes in accordance with various embodiments will be described in detail, with reference to the accompanying drawings.

Figure 5:
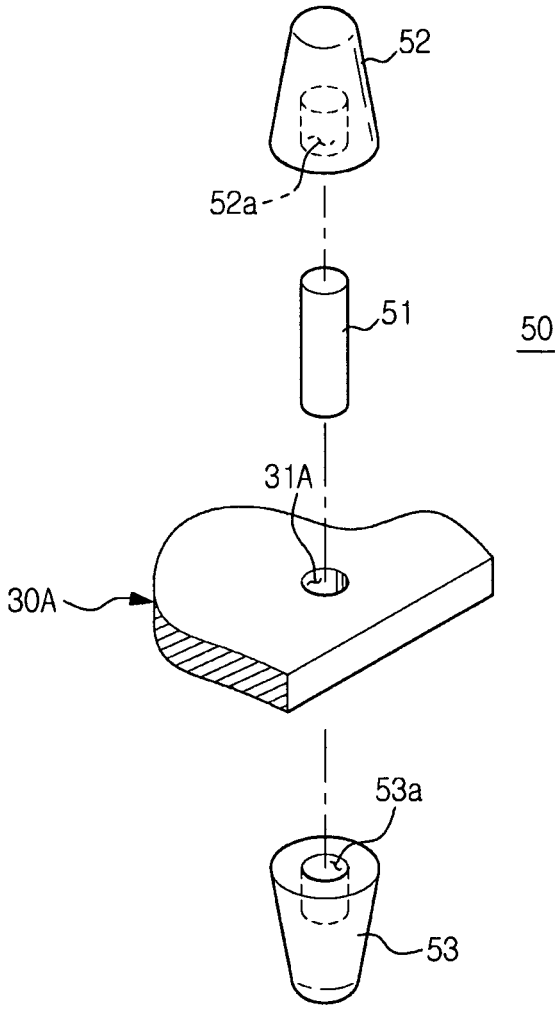
FIGS. 5 to 7 are perspective views respectively illustrating mounting structures of support members of electric precipitators in accordance with various embodiments, applied to low voltage electrodes.

As shown in FIG. 5, mounting holes 31A to mount support members 50 on a low voltage electrode 30A are formed through the low voltage electrode 30A in accordance with another embodiment. Each of the support members 50 includes a mounting part 51 penetrating the mounting hole 31A, and a pair of support parts 52 and 53, respectively provided with connection recesses 52*a* and 53*a*, into which both ends of the mounting part 51 are respectively inserted, and front ends respectively supported by the film members 21 of the high voltage electrodes 20A neighboring the low voltage electrode 30A.

Therefore, the support members 50 are mounted on the low voltage electrode 30A by installing the mounting parts 51 within the mounting holes 31A and then inserting both ends of the mounting parts 51 into the connection recesses 52*a* and 53*a* of the pair of the support parts 52 and 53.

Figure 6:
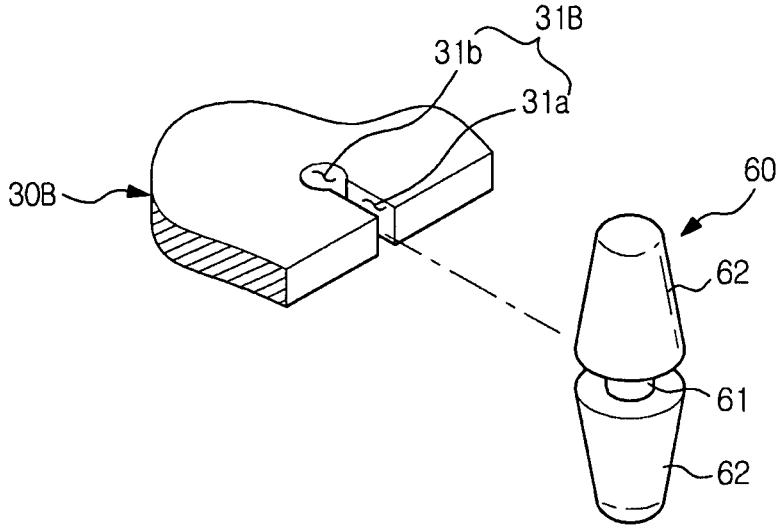

As shown in FIG. 6, mounting recesses 31B opened toward a side end of a low voltage electrode 30B to mount support members 60 on the low voltage electrode 30B are formed on the low voltage electrode 30B in accordance with another embodiment. Each of the support members 60 includes a mounting part 61 installed in the mounting recess 31B, and a pair of support parts 62 respectively formed integrally with both ends of the mounting part 61 and provided with front ends respectively supported by the high voltage electrodes 20A neighboring the low voltage electrode 30B. Here, the mounting recess 31B includes an inlet part 31*a* formed on the side end of the low voltage electrode 30B so as to have a smaller width than that of the mounting part 61, and a reception part 31*b* formed at the inside of the inlet part 31*a* in a shape corresponding to the mounting part 61 so as to receive and support the mounting part 61.

Therefore, the support members 60 are mounted on the low voltage electrode 30B by inserting the mounting parts 61 of the support members 60 into the reception parts 31*b* via the inlet parts 31*a* of the mounting recesses 31B in an interference fit type.

Figure 7:
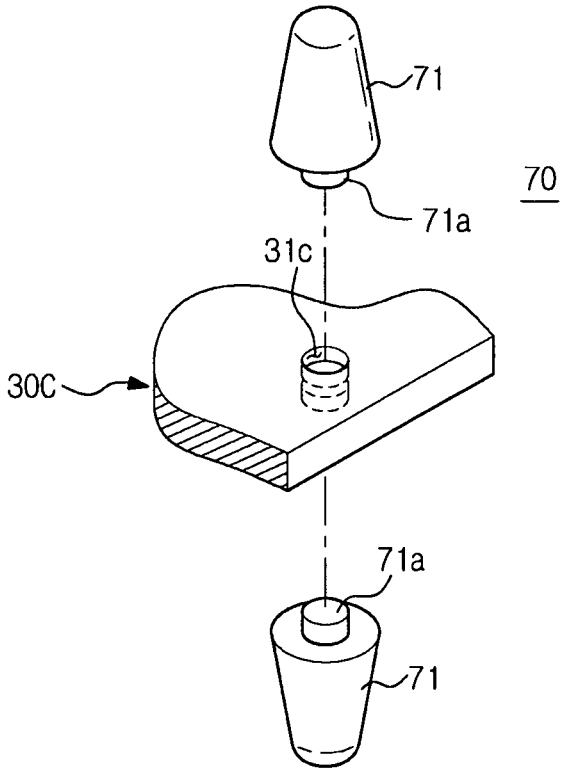

As shown in FIG. 7, mounting recesses 31*c* respectively opened toward high voltage electrodes 20A neighboring a low voltage electrode 30C to mount support members 70 on the low voltage electrode 30C are respectively formed on both surfaces of the low voltage electrode 30C in accordance with another embodiment. Each of the support members 70 includes a pair support parts 71 respectively provided integrally with mounting parts 71*a* inserted into the mounting recesses 31*c*.

Therefore, the support members 70 are mounted on the low voltage electrode 30C by inserting the respective mounting parts 71*a* of the two support parts 71 into the mounting recesses 31*c* formed on both surfaces of the low voltage electrode 30C.

Although the above embodiments illustrate the support members 40, 50 and 60 mounted on the low voltage electrodes 30A, 30B, and 30C, the support members 40, 50, and 60 may be mounted on high voltage electrodes 20B, 20C and 20D in accordance with other embodiments, as shown in FIGS. 8 to 11, which will be described below.

Figure 8:
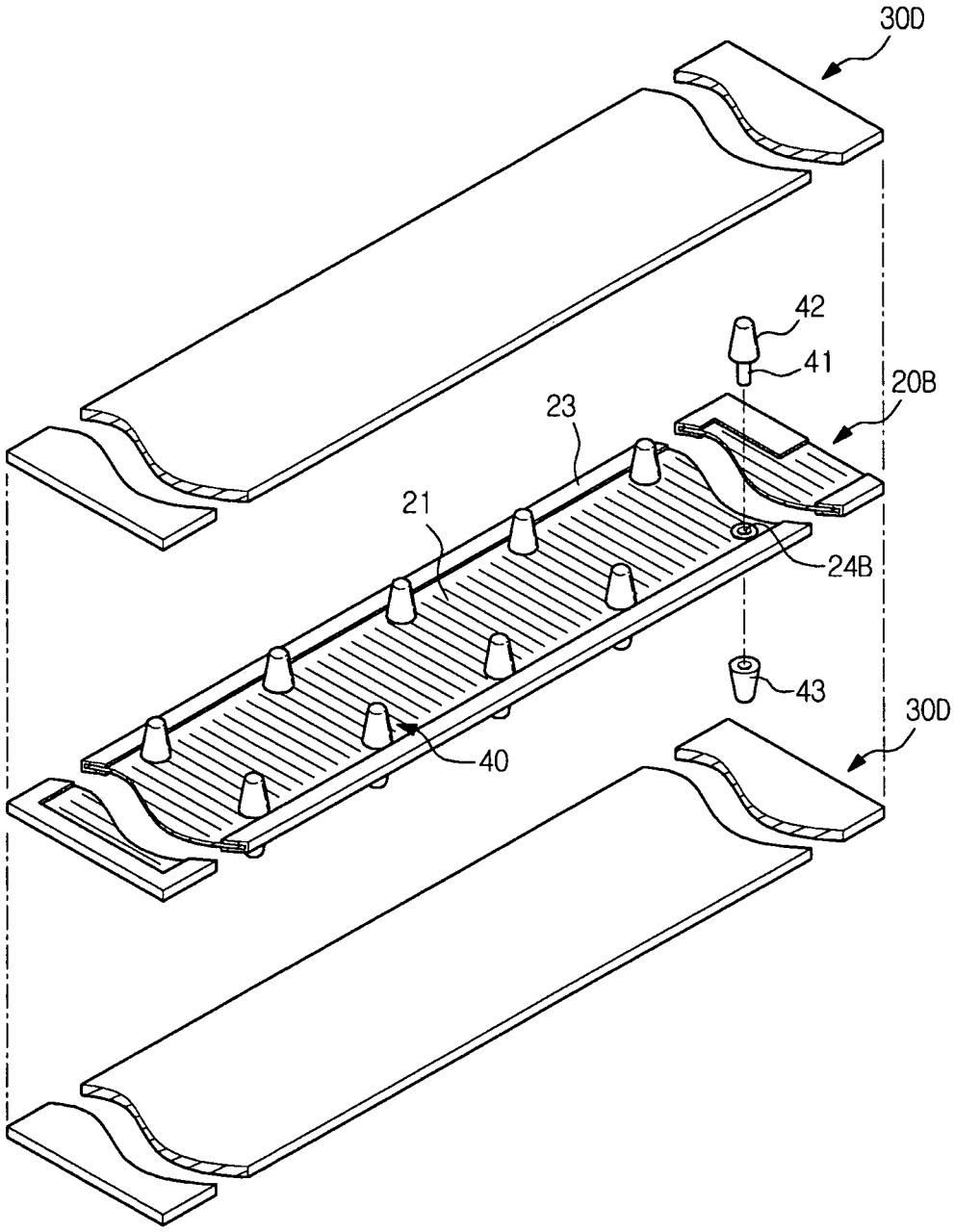
FIG. 8 is an exploded perspective view illustrating a mounting state of support members of an electric precipitator in accordance with one embodiment on a high voltage electrode.

Hereinafter, mounting structures of support members 40 on high voltage electrodes 20B of an electric precipitator 100 including the high voltage electrodes 20B and low voltage electrodes 20C alternately disposed so as to be separated from each other, as shown in FIG. 8, in accordance with various embodiments will be described in detail, with reference to the accompanying drawings.

Figure 9:
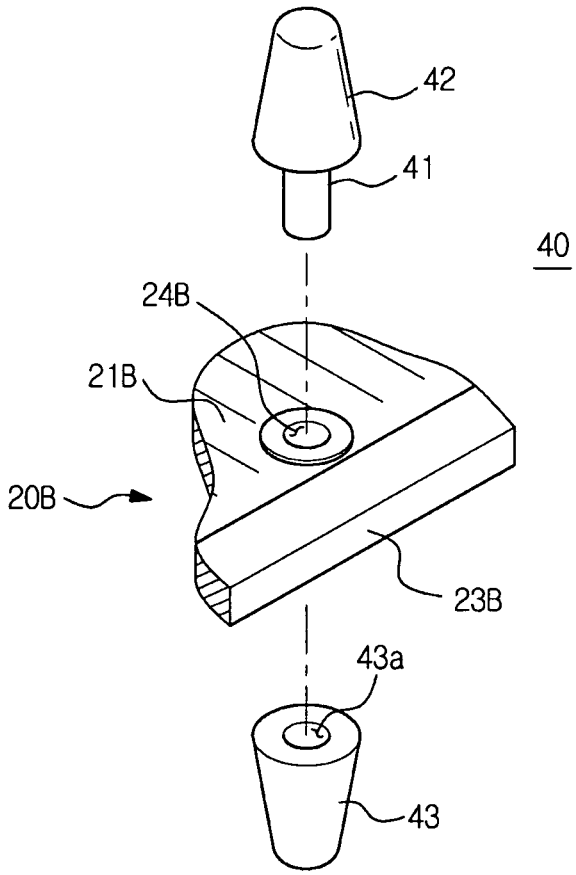
FIGS. 9 to 11 are perspective views respectively illustrating mounting structures of support members of electric precipitators in accordance with various embodiments, applied to high voltage electrodes.

As shown in FIG. 9, mounting holes 24B to mount support members 40 on a high voltage electrode 20B including a frame 23B are formed through the high voltage electrode 20B in accordance with another embodiment. Each of the support members 40 includes a first support part 42 provided with a mounting part 41 formed integrally with one side thereof and penetrating the mounting hole 24B, and a second support part 43 provided with a connection recess 43*a*, into which the front end of the mounting part 41 protruded from the mounting hole 24B is inserted.

Therefore, the support members 40 are mounted on the high voltage electrode 20B by inserting the mounting parts 41 of the first support parts 42 into the mounting holes 24B and then inserting the front ends of the mounting parts 41 protruded from the mounting holes 24B into the connection recesses 43*a* of the second support parts 43.

Further, the support members 50, as shown in FIG. 5, may be applied to the high voltage electrode 20B in accordance with this embodiment.

Figure 10:
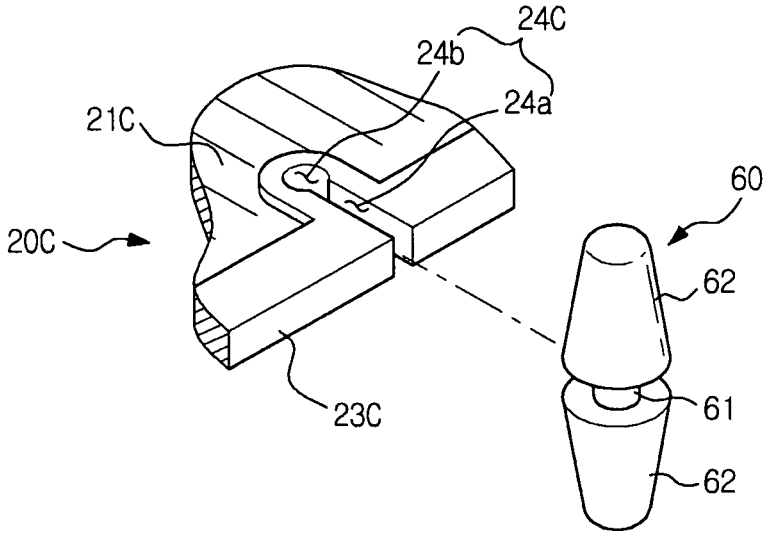

As shown in FIG. 10, mounting recesses 24C opened toward a side end of a high voltage electrode 20C including a film 21C, to mount support members 60 on the high voltage electrode 20C are formed on a frame part 23C of the high voltage electrode 20C in accordance with another embodiment. Each of the support members 60 includes a mounting part 61 inserted into the mounting recess 24C, and a pair of support parts 62 respectively formed integrally with both ends of the mounting part 61 and provided with front ends respectively supported by the low voltage electrodes 30D neighboring the high voltage electrode 20C. Here, the mounting recess 24C includes an inlet part 24*a* having a smaller width than that of the mounting part 61 of the support member 60, and a reception part 24*b* formed at the inside of the inlet part 24*a* in a shape corresponding to the mounting part 61 so as to receive and support the mounting part 61.

Therefore, the support members 60 are mounted on the high voltage electrode 20C by inserting the mounting parts 61 of the support members 60 into the reception parts 24*b* via the inlet parts 24*a* of the mounting recesses 24C in an interference fit type.

Figure 11:
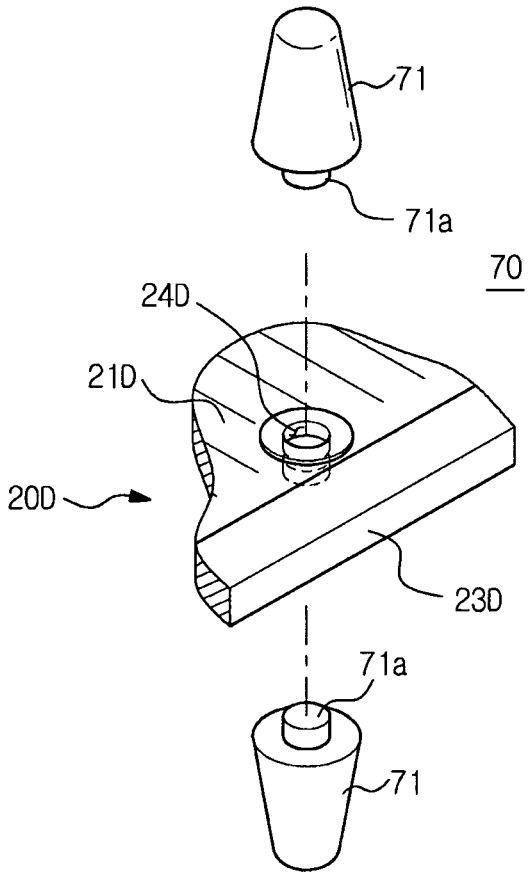

As shown in FIG. 11 mounting recesses 24D respectively opened toward low voltage electrodes 30D neighboring a high voltage electrode 20D, including film member 21D and frame 23D, to mount support members 70 on the high voltage electrode 20D are respectively formed on both surfaces of the high voltage electrode 20D in accordance with another embodiment. Each of the support members 70 includes a pair support parts 71 respectively provided integrally with mounting parts 71*a* inserted into the mounting recesses 24D.

Therefore, the support members 70 are mounted on the high voltage electrode 20D by inserting the respective mounting parts 71*a* of the two support parts 71 into the mounting recesses 24D formed on both surfaces of the high voltage electrode 20D.

Figure 12:
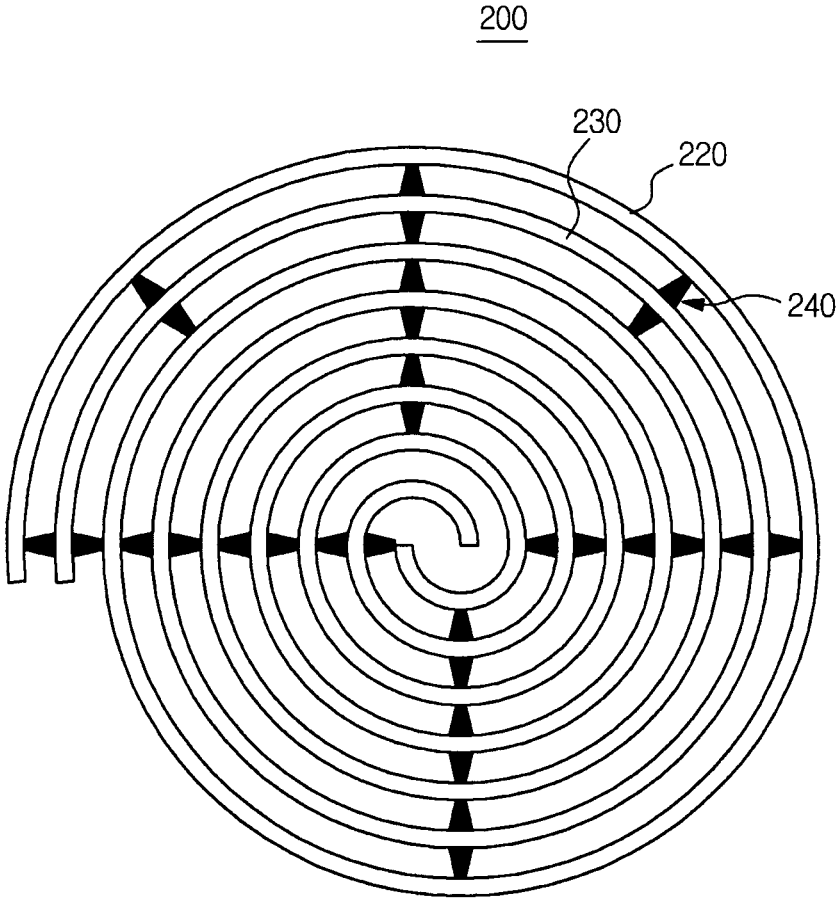
FIG. 12 is a schematic view illustrating support members in accordance with another embodiment, applied to a scroll-type electric precipitator.

Although the above embodiments illustrate the electric precipitators in which the high voltage electrodes and the low voltage electrodes are respectively formed in a flat plate shape and are separated from each other in the width direction thereof, a high voltage electrode 220 and a low voltage electrode 230 may be respectively formed in a spiral plate shape and be separated from each other in the radial direction to form a scroll type electric precipitator 200, as shown in FIG. 12. In this case, support members 240 are mounted on the low voltage electrode 230 such that the high voltage electrode 220 is supported in the radial direction, thereby maintaining a separation state between the high voltage electrode 220 and the low voltage electrode 230 at a designated distance in the radial direction.

As is apparent from the above description, an electric precipitator in accordance with one embodiment includes support members to allow film members of high voltage electrodes to be supported by low voltage electrodes, and thus prevents sagging of the film members through the support members, thereby stably maintaining separation of the high voltage electrodes and the low voltage electrodes from each other.

Further, since the separation of the high voltage electrodes and the low voltage electrodes from each other is maintained by the support members made of an insulating material, a relatively high voltage may be applied to the high voltage electrodes, and thus the performance of the electric precipitator may be improved.

Although a few embodiments have been shown and described, it would be appreciated by those skilled in the art that changes may be made in these embodiments without departing from the principles and spirit of the embodiments, the scope of which is defined in the claims and their equivalents.

What is claimed is:

1. An electric precipitator comprising:

a high voltage electrode and a low voltage electrode are separated from each other, the high voltage electrode including a pair of film members made of a non-conductive material and attached to each other, and an electrode layer disposed between the pair of film members; and a plurality of support members each comprising an insulating member, and mounted on one of the high voltage electrode and the low voltage electrode to allow the film members to be supported by the low voltage electrode.

2. The electric precipitator according to claim 1, further comprising a pair of the high voltage electrodes, wherein the support members are mounted on the low voltage electrode, and thus respectively support the pair of high voltage electrodes disposed at both sides of the low voltage electrode.

3. The electric precipitator according to claim 1, further comprising a pair of the low voltage electrodes, wherein the support members are mounted on the high voltage electrode, and thus respectively support the pair of low voltage electrodes disposed at both sides of the high voltage electrode.

4. The electric precipitator according to claim 1, further comprising a plurality of mounting holes to mount the support members, formed through one of the high and low voltage electrodes, and each of the support members includes a first support part and a mounting part formed integrally with the first support part and penetrating each of the mounting holes, and a second support part comprising a connection recess, into which a front end of the mounting part is inserted.

5. The electric precipitator according to claim 1, further comprising a plurality of mounting holes to mount the support members, formed through one of the high and low voltage electrodes, and each of the support members includes a mounting part penetrating each of the mounting holes and a pair of support parts respectively comprising connection recesses, into which ends of the mounting part are respectively inserted.

6. The electric precipitator according to claim 1, further comprising a plurality of mounting recesses to mount the support members, formed on one of the high and low voltage electrodes to be opened to a side end of the one of the high and low voltage electrodes, and each of the support members includes a mounting part mounted in each of the mounting recesses and a pair of support parts formed integrally with both ends of the mounting part.

7. The electric precipitator according to claim 6, wherein each of the mounting recesses includes an inlet part formed on a side end of the one of the high and low voltage electrodes and has a smaller width than a width of each of the mounting parts, and a reception part formed at an inside of the inlet part and having a shape corresponding to the mounting parts.

8. The electric precipitator according to claim 1, further comprising a pair of mounting recesses to mount the support members on one of the high and low voltage electrodes, and two more of one of the high and low voltage electrodes, the support members being mounted to be respectively opened to the two more electrodes neighboring the one of the electrodes, and each of the support members includes a pair of support parts respectively provided with mounting parts inserted into the mounting recesses.

9. The electric precipitator according to claim 1, wherein the high voltage electrode and the low voltage electrode are respectively formed in a flat plate shape, and are separated from each other in a thickness direction of the plate.

10. The electric precipitator according to claim 1, wherein the high voltage electrode and the low voltage electrode are each formed in a spiral plate shape, and are separated from each other in a radial direction of the plate.

11. The electric precipitator according to claim 1, wherein further comprising two of the high voltage electrodes and two of the low voltage electrodes alternating with the high voltage electrodes, and a case to fix the high voltage electrodes and the low voltage electrodes formed at the outside of the plurality of electrodes.

12. The electric precipitator according to claim 1, wherein the high voltage electrode further includes a frame formed at the edge thereof to maintain the attachment of the film members and the electrode layer to each other.

13. The electric precipitator according to claim 1, wherein the high voltage electrode and the low voltage electrode are separated from each other by an interval of 1~3 mm by the support members.

14. The electric precipitator according to claim 1, wherein a voltage of 4~8 kv is applied to the high voltage electrode.

15. The electric precipitator according to claim 1, further comprising a plurality of the high voltage electrodes, and a plurality of the low voltage electrodes, disposed alternately with the plurality of high voltage electrodes.

16. An electric precipitator comprising:

a high voltage electrode including a pair of film members made of a non-conductive material and attached to each other;

a low voltage electrode separated from the high voltage electrode; and a plurality of support members comprising an insulating member to maintain separation of the high voltage electrode and the low voltage electrode.

17. The electric precipitator according to claim 16, wherein an electrode layer is disposed between the pair of film members, and the support members support the film members to the low voltage electrode to prevent sagging of the film members.

18. The electric precipitator according to claim 17, further comprising at least four of the support members mounted on one of the high voltage electrode and the low voltage electrode, and each of the support members includes a pair of support parts protruded from the one of the high voltage electrode and low voltage electrode, on which the support members are mounted, to both sides.

19. The electric precipitator according to claim 18, wherein each of the pair of support parts has a length of 1~3 mm, and a voltage of 4~8 kv is applied to the high voltage electrode.

20. The electric precipitator according to claim 18, wherein the support members are disposed on the low voltage electrode in at least two rows in a length direction thereof.

21. The electric precipitator according to claim 18, further comprising a plurality of mounting holes formed through the one of the high voltage electrode and the low voltage electrode, on which the support members are mounted, to allow the pair of support parts to pass through the one of the high voltage electrode and the low voltage electrode and to be connected to each other.

* * * * *

UNITED STATES PATENT AND TRADEMARK OFFICE

CERTIFICATE OF CORRECTION

PATENT NO. : 8,512,455 B2
APPLICATION NO. : 12/662556
DATED : August 20, 2013
INVENTOR(S) : Kochiyama Yasuhiko et al.

It is certified that error appears in the above-identified patent and that said Letters Patent is hereby corrected as shown below:

On the Title Page, Column 2 item [57] (Abstract), Line 7, After "that" delete "that".

Signed and Sealed this
Eighteenth Day of February, 2014

Michelle K. Lee

Michelle K. Lee
*Deputy Director of the United States Patent and Trademark Office*